US005613575A

United States Patent [19]

Ackermann

[11] Patent Number: 5,613,575

[45] Date of Patent: Mar. 25, 1997

[54] FLAT-STRUCTURE LIFTING PLATFORM

[75] Inventor: Willy Ackermann, Kappel, Switzerland

[73] Assignee: Ackermann Inter Ltd., Switzerland

[21] Appl. No.: 406,968

[22] PCT Filed: Aug. 10, 1994

[86] PCT No.: PCT/IB94/00253

§ 371 Date: Mar. 16, 1995

§ 102(e) Date: Mar. 16, 1995

[87] PCT Pub. No.: WO95/04698

PCT Pub. Date: Feb. 16, 1995

[30] Foreign Application Priority Data

Aug. 10, 1993 [AT] Austria ..... 1600/93

[51] Int. Cl.[6] ..... A66F 7/06

[52] U.S. Cl. ..... 187/211; 254/10 B

[58] Field of Search ..... 187/211, 210, 187/269, 233, 240; 254/10 B, 8 B, 89 H, 89 R

[56] References Cited

U.S. PATENT DOCUMENTS

| | | | |
|---|---|---|---|
| 3,275,297 | 9/1966 | Bloch | 254/10 B |
| 4,248,405 | 2/1981 | Kameda | 254/10 B |
| 4,798,266 | 1/1989 | Finkbeiner | 187/211 |

FOREIGN PATENT DOCUMENTS

| | | |
|---|---|---|
| 0336927 | 4/1988 | European Pat. Off. . |
| 0336927 | 8/1989 | European Pat. Off. . |
| 705288 | 3/1931 | France . |
| 741863 | 12/1933 | France . |
| 2131487 | 6/1973 | Germany . |
| 757746 | 4/1956 | United Kingdom . |
| 2055754 | 11/1981 | United Kingdom . |

*Primary Examiner*—Kenneth Noland
*Attorney, Agent, or Firm*—Nixon & Vanderhye P.C.

[57] ABSTRACT

The flat lift assembly has a lift platform (11), which is articulated on a base frame via a pivotable lifting arm (7). For the pivot drive of the lifting arm (7) an arm (1) and a cylinder-piston unit (5) are provided, wherein the arm (2) is acting as an articulated lever and this articulated lever is supported via an arm (2) on the base frame. The joint (9) of the arm (1) on the lifting arm (7) lies in the reeled-in position of the lifting arm (7) higher than the joint (4) of the cylinder-piston unit (5) on the arm (1). The arm (1) is formed as a pivotable two-armed lever in the form of an articulated lever, whose pivot axis lying between the free ends of the two-armed lever is pivotably supported at the base frame via at least one further arm (2) in height direction.

3 Claims, 2 Drawing Sheets

FLAT-STRUCTURE LIFTING PLATFORM

The invention relates to a flat lift assembly with a lift platform, which is articulated on a lifting arm, which is pivotably supported on a base frame, wherein the lifting arm is pivotable about a pivot axis on the base frame by a drive means being connected with the lifting arm and wherein the drive means is connected with the lifting arm via an arm with a joint above the pivot axis of the lifting arm on the base frame, which joint lies in the reeled-in position of the lifting arm higher than the joint of the drive means on the arm.

Lift assemblies which should be constructed in that in the reeled-in position of the platform or the lift platform there remain no parts in a position projecting in height direction above the lift platform are known from WO 89/11437 or WO 89/11438 for example. This known devices are moving devices, with which a lifting of a motor vehicle about a predefined lift of stroke is possible, for example for changing the tires. The known constructions need a relatively large drive means, if loads should be lifted from the extended position of the drive means. Normally a load is grasped and lifted with such devices only after an predefined stroke.

A further lift assembly, which is known from DE-OS 36 04 456, allows to lift a platform via a scissors-type arrangement with hydraulic cylinder-piston units, which are arranged essentially parallel to a base area. With such scissor-type jacks the introduction of force is relatively unfavourable in the first part of the extending movement, so that a relatively great construction height is needed for lifting loads also from the reeled-in position. This is in analogeous manner also correct for the lift platforms guided by parallelogram arms, as they are known from U.S. Pat. No. 3,865,214 and U.S. Pat. No. 5,040,637. Also with such lift platforms, whose parallel guidance relatively to the floor is guaranteed by parallelogram arms, the introduction of force is very unfavourable in a first part of the extending movement so that great loads can only be lifted, if a relatively great construction height and an overdimensioned drive means are provided.

Therefore, the invention aims to provide a flat lift assembly as mentioned above, with which heavy loads may also be safely lifted with a substantial smaller construction height and smaller drive aggregates from the fully reeled-in position. The flat construction should make it especially possible that such a lift assembly may be installed also subsequently in floor constructions or ceiling constructions of a workshop without a strengthening of the floor or the ceiling being necessary and without being necessary to build openings in the floor or the ceiling for providing the necessary room for the drive aggregates.

For solving this problem the present lift assembly is characterized in that the arm is formed as a pivotable two-armed lever in the form of an articulated lever, whose pivot axis lying between the free ends of the two-armed lever is pivotably supported at the base frame via at least one further arm in height direction. Because the drive means is connected with the lifting arm via an arm with a joint above the pivot axis of the lifting arm on the base frame, a type of articulated lever is formed, wherein, if the drive means is extended, at the beginning a first partial rotation of the lifting arm is provided under the action of the articulated arm. The transmission of the articulated arm allows the use of a substantially smaller drive means and therefore a flatter construction, if the drive means should be arranged under the lift platform in the base frame. Because the drive means is connected under the joint of the arm on the lifting arm on the arm and because the same drive means is connected with its other end on the lifting arm it is secured that the joint of the drive means on the arm is always biased in direction to the base frame because of the introduction of force, whereas the other end of the arm, which is connected with the lifting arm above this joint, is moving up, when the lower joint of the arm is moving in a direction, which may be essentially parallel to the base frame, whereby the first part of the swivelling motion of the lifting arm is startet. Such construction of an articulated arm allows a substantially better introduction of force and a transmission in the first part of the swivelling path whereby it is altogether possible to construct flatter and make shift with smaller drive aggregates. The drive means may preferably be a hydraulic cylinder-piston unit, wherein naturally also other forms of linear drive means, such as spindle drives or so on are possible. The joint of the arm acting as articulated arm on the drive means is of course because of its position always held in contact with the base frame. This joint may also be guided in an elongated hole being parallel to the floor surface or secured against an ascending by a stop motion device.

According to the invention the embodiment is characterized in that the arm is formed as a pivotable two-armed lever, whose pivot axis is pivotably supported at the base frame in height direction via at least one further arm. In principle it is sufficient because of the position of the joint of the arm on the lifting arm and on the drive means in the totally reeled-in position that the lower end of the arm is slidably guided in the base frame for providing the desired action as articulated arm. The action as articulated arm and the operating safety are, however, improved by a swivel joint wherein because of the fact that at least one further arm is pivotally supported on the base frame, the advantageous transmission of the articulated arm gear via a longer swivelling path is achieved.

For providing a parallel guidance of the lift platform relatively to the plane of the base frame the embodiment is advantageously such that the lift platform is connected with an arm, being parallel to the lifting arm and being guided in parallel direction to the floor surface.

For guaranteeing that by starting the drive means in the totally reeled-in position of the lifting arm the desired swivelling motion of the articulated arm and of the pivot axis of the articulated arm, which is formed as two-armed lever, begins, the embodiment is advantageously such that the joint of the two-armed lever lies in the reeled-in position of the lift platform above the joint for the connection of the hydraulic cylinder-piston unit. In this way a kinematics is guaranteed, in which also for small dimensioned drive means high lifting forces can be effective from the totally reeled-in position.

A very compact construction can be achieved in that the arm or arms is (are) connected with the base frame for supporting the two-armed lever coaxially to the pivot axis of the parallelogram arms of the lift platform.

The invention will be explained in more detail thereafter with reference to an exemplary embodiment being shown in the drawing.

BRIEF DESCRIPTION OF THE DRAWINGS

In this drawing

In FIG. 1 there is shown an arm 1 which is formed as a two-armed lever and which is effective as an articulated lever.

Figure 1:
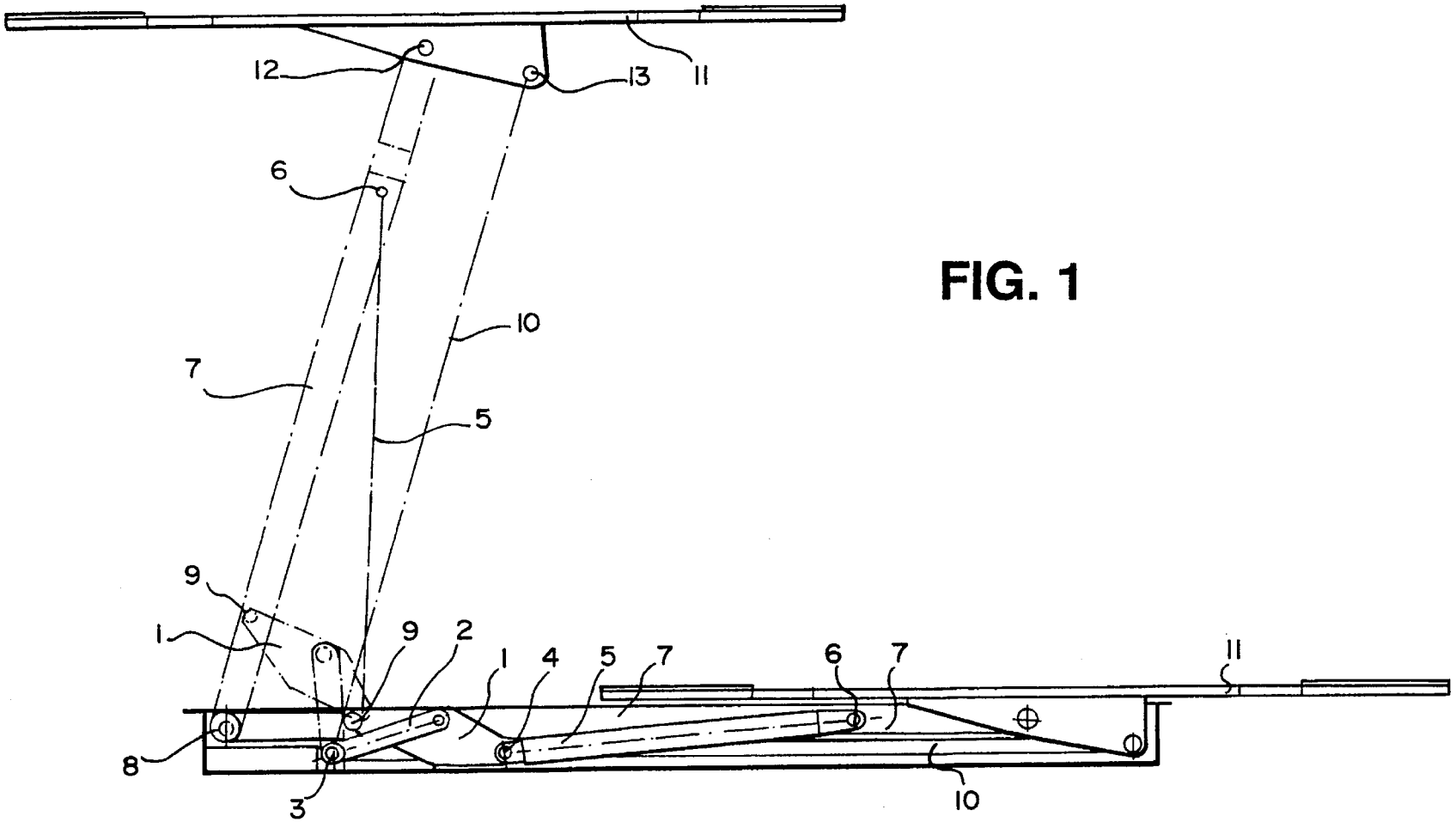
FIG. 1 shows a side view of the lift assembly in the reeled-in position of the lift platform and in the end position with the lateral wall removed.

The arm 1 is pivotably connected with the base frame via two further arms 2, wherein the pivot axis is designated with 3. At one free end of the two-armed lever 1 is connected a hydraulic cylinder-piston unit 5 with a pivot axis 4, whose other free end is pivotably connected with a lifting arm 7 via a pivot axis 6. The lifting arm 7 is pivotally connected with the base frame via an axis 8. The second free end of the two-and lever 1 is connected with the lifting arm 7 at a joint 9. There is further shown an arm 10, which together with the lifting arm 7 provides a parallel guidance of the lift platform 11, wherein the paralleologram arms 7 and 10 are connected with the lift platform 11 via the pivot axes 12 and 13. Thereby the arms 7 and 10 are guiding the lift platform 11 parallel relative to the plane of the base frame.

Figure 2:
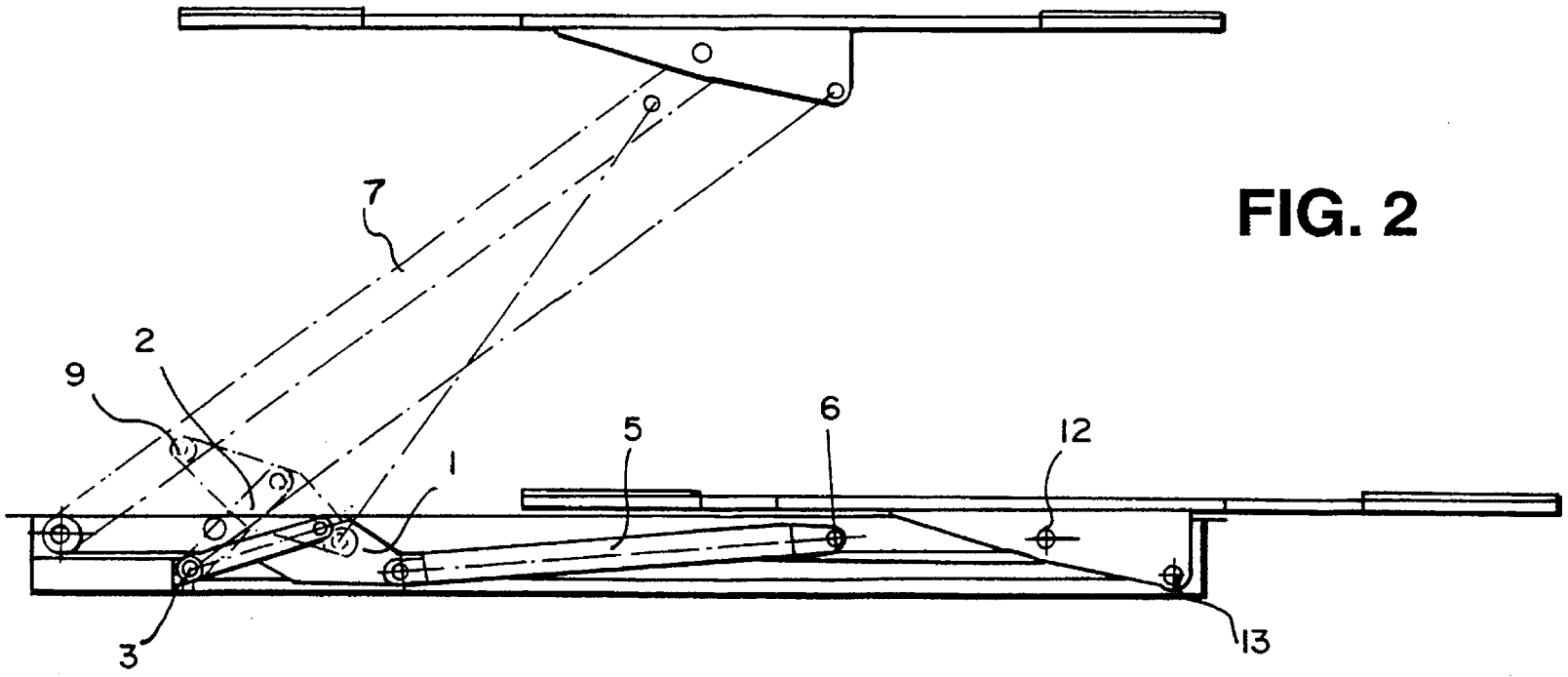
FIG. 2 shows an analogous representation with the lift platform in semi-lifted position and FIG. 3 shows a top view of the representation of FIG. 1 at a position under the lift platform.

As it may be seen clearly from a combination of FIG. 1 and FIG. 2 a displacement of the two-armed lever 1 acting as an articulated arm is provided by the activation of the cylinder-piston unit 5. With this displacement the arms 2 are also swivelled around their pivot axis 3 at the same time, therefore the first two-armed lever 1, which is acting as an articulated lever, is swivelled altogether in a higher position, whereby the introduction of force in the lifing arm 7 is further improved. With a pivotation of the two-armed lever 1 and therefore of the lifting arm 7 naturally also the pivot axis 6 of the drive means 5 being formed as a cylinder-piston aggregate, is swivelled whereby the introduction of force will be sucessively better. The best introduction of force is obtained in the position, which is shown in FIG. 1 with dotted lines, in which position the cylinder-piston unit is orientated substantially in vertical direction.

Figure 3:
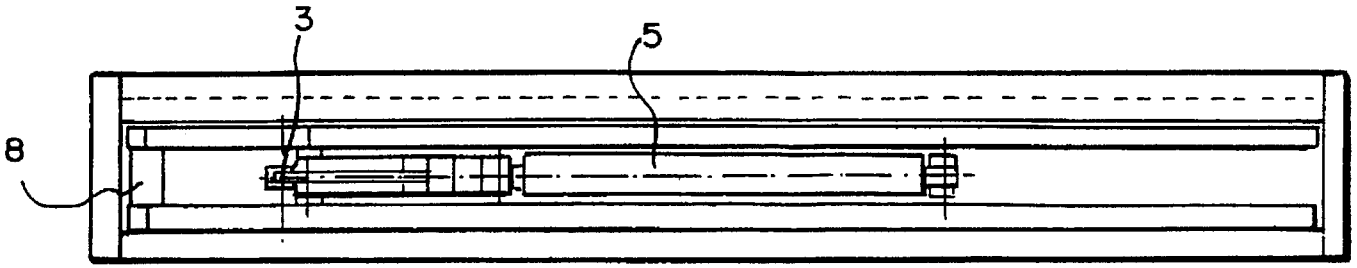

The details of the construction and especially the compact construction is further illustrated in FIG. 3. In FIG. 3 it is shown that the pivot axis 3 of the arm 2 coincides substantially with the pivot axis of the Parallelogram arms 10, whereby a particularly compact construction is obtained.

I claim:

1. Flat lift assembly with a lift platform, which is articulated on a lifting arm, which is pivotably supported on a base frame, wherein the lifting arm is pivotable about a pivot axis on the base frame by a drive means being connected with the lifting arm and wherein the drive means (5) is connected with the lifting arm (7) via an arm (1) with a joint (9) above the pivot axis of the lifting arm (7) on the base frame, which joint lies in the reeled-in position of the lifting arm (7) higher than the joint (4) of the drive means (5) on the arm (1), characterized in that the arm (1) is formed as a pivotable two-armed lever in the form of an articulated lever, whose pivot axis lying between the free ends of the two-armed lever is pivotably supported at the base frame via at least one further arm (2) in height direction.

2. Flat lift assembly according to claim 1, characterized in that the lift platform (11) is connected with an arm (10), being parallel to the lifting arm (7) and being guided in parallel direction to the floor surface.

3. Flat lift assembly according to claim 1, characterized in that the arm (2) or arms (2) is (are) connected with the base frame for supporting the two-armed lever (1) coaxially to the pivot axis (3) of the parallelogram arms (10) of the lift platform (11).

* * * * *